US006467229B2

(12) United States Patent
Azar

(10) Patent No.: US 6,467,229 B2
(45) **Date of Patent: *Oct. 22, 2002**

(54) MORTARLESS BRICK

(76) Inventor: Tony J. Azar, 3555 North Service Road, East Windsor, Ontario (CA), N8W 5R7

( * ) Notice: Subject to any disclaimer, the term of this patent is extended or adjusted under 35 U.S.C. 154(b) by 0 days.

This patent is subject to a terminal disclaimer.

(21) Appl. No.: 09/804,167

(22) Filed: Mar. 12, 2001

(65) Prior Publication Data

US 2001/0029719 A1 Oct. 18, 2001

Related U.S. Application Data

(63) Continuation-in-part of application No. 09/466,108, filed on Dec. 17, 1999, now Pat. No. 6,253,518.

(30) Foreign Application Priority Data

Dec. 24, 1998 (CA) ..... 2257032
Oct. 13, 1999 (CA) ..... 2285832

(51) Int. Cl.[7] ..... E04B 2/08

(52) U.S. Cl. ..... 52/589.1; 52/590.1; 52/590.2; 52/592.1; 52/592.6

(58) Field of Search ..... 52/589.1, 590.1, 52/590.2, 592.1, 592.6, 311.2, 578, 596, 612, 284, 286

(56) References Cited

U.S. PATENT DOCUMENTS

| | | | | | |
|---|---|---|---|---|---|
| 5,715,635 | A | * | 2/1998 | Sherwood | 52/286 |
| 5,775,047 | A | * | 7/1998 | Jensen | 52/596 |
| 5,820,304 | A | * | 10/1998 | Sorheim et al. | 405/286 |
| 5,960,604 | A | * | 10/1999 | Blanton | 52/604 |
| 6,145,266 | A | * | 11/2000 | Vondross | 52/604 |

FOREIGN PATENT DOCUMENTS

| | | |
|---|---|---|
| NZ | 107214 | 3/1952 |
| NZ | 118691 | 4/1958 |
| NZ | 140791 | 5/1966 |
| NZ | 183115 | 1/1977 |
| NZ | 210268 | 11/1984 |

* cited by examiner

*Primary Examiner*—Lanna Mai
*Assistant Examiner*—Phi Dieu Tran A
(74) *Attorney, Agent, or Firm*—Anthony J. Casella; Gerald E. Hespos

(57) ABSTRACT

A building block is provided for stacking with other like building blocks to fabricate a wall. The building block has top, bottom, front, rear and end surfaces. The front and rear surfaces are substantially planar. The top surface is ridged and the bottom surface is channeled to intermit with the ridge on the said bottom surface. The ends are notched so as to overlap, and present the appearance of a brick wall.

12 Claims, 13 Drawing Sheets

MORTARLESS BRICK

FIELD OF THE INVENTION

This application is a continuation-in-part of U.S. application Ser. No. 09/466,108 filed Dec. 17, 1999, now U.S. Pat. No. 6,253,518.

BACKGROUND OF THE INVENTION

The invention is a building block of the type commonly referred to as a mortarless brick. That is, the building block of the present invention is stackable to present the appearance of a brick wall, but without the application of mortar between adjacent bricks Lar and courses of bricks. It is particularly appropriate for applications in which the appearance of a brick surface is desired, but cost considerations do not permit bricking of a wall. Moreover, it will be appreciated that in many, or even most, situations, brick is not used as a structural support material, but rather for its aesthetic appeal. Therefore, it is desired to provide a low cost alternative to traditional brick wall construction, while retaining the appearance of brick.

A mortarless brick product is described in Canadian Patent Application No. 2,220,413 (Bouchard et al). In that patent application, a mortarless brick product is described as:

"A tongue and mortise block, for use in the construction of a wall wherein a plurality of like blocks are stacked in successive mortarless overlapping courses so as to define a wall face, said tongue and mortise block comprising
two side ends spaced apart by
a top face
a bottom face
a front face and
a rear face said top face comprising a tongue interlock element and a declining face portion, said declining face portion connecting the tongue interlock element to the front face, said bottom face comprising a mortise interlock element and a forward face portion, said forward face portion connecting the mortise interlock element to the front face, said two side ends, said top face, said bottom face, said front face and said rear face being configured such that, when said block and an underlying, like, block form part of the wall and the bottom face of the block engages the top face of a said underlying, like, block such that the front face of the block defines a portion of the wall face, the tongue interlock element of a said underlying block is able to register in the mortise interlock element of the block so as to be able to interlock both blocks such that relative forward and rearward displacement is inhibited, and the front face of the block is vertically offset downwardly relative to the tongue element thereof."

It is observed that the "declining faces" of the Bouchard et al brick, which function to provide a secure tongue and groove type of fit between courses, also give the Bouchard et al brick a depth that approximates that of a standard brick The applicant has discovered that it is not necessary to approximate the dimensions of a standard brick to provide a mortarless brick with all of the essential attributes of a mortarless brick. That is, the applicant has designed a mortarless brick incorporating features that make it possible for the brick to have considerably less depth, and consequently less weight, while still having a "genuine" brick appearance.

OBJECT OF THE INVENTION

An object of the present invention, therefore, is to provide a mortarless brick that is lightweight, and easy to assemble into a wall.

A further object of the present invention is to provide a mortarless brick that resists the incursion of water behind the brick.

A further object of the present invention is to provide a mortarless brick that interfits with adjacent bricks in a course of bricks.

In a broad aspect, then, the present invention relates to a building block for stacking with other like building blocks to fabricate a wall, said building block having top, bottom, front rear and end surface, the front and rear surfaces being substantially planar, the top surface being ridged and the bottom surface being channeled to intermit with the ridge on the said bottom surface, and the ends being notched so as to overlap.

BRIEF DESCRIPTION OF THE DRAWINGS

In drawings that illustrate the present invention by way of example.

DETAILED DESCRIPTION

Figure 27:
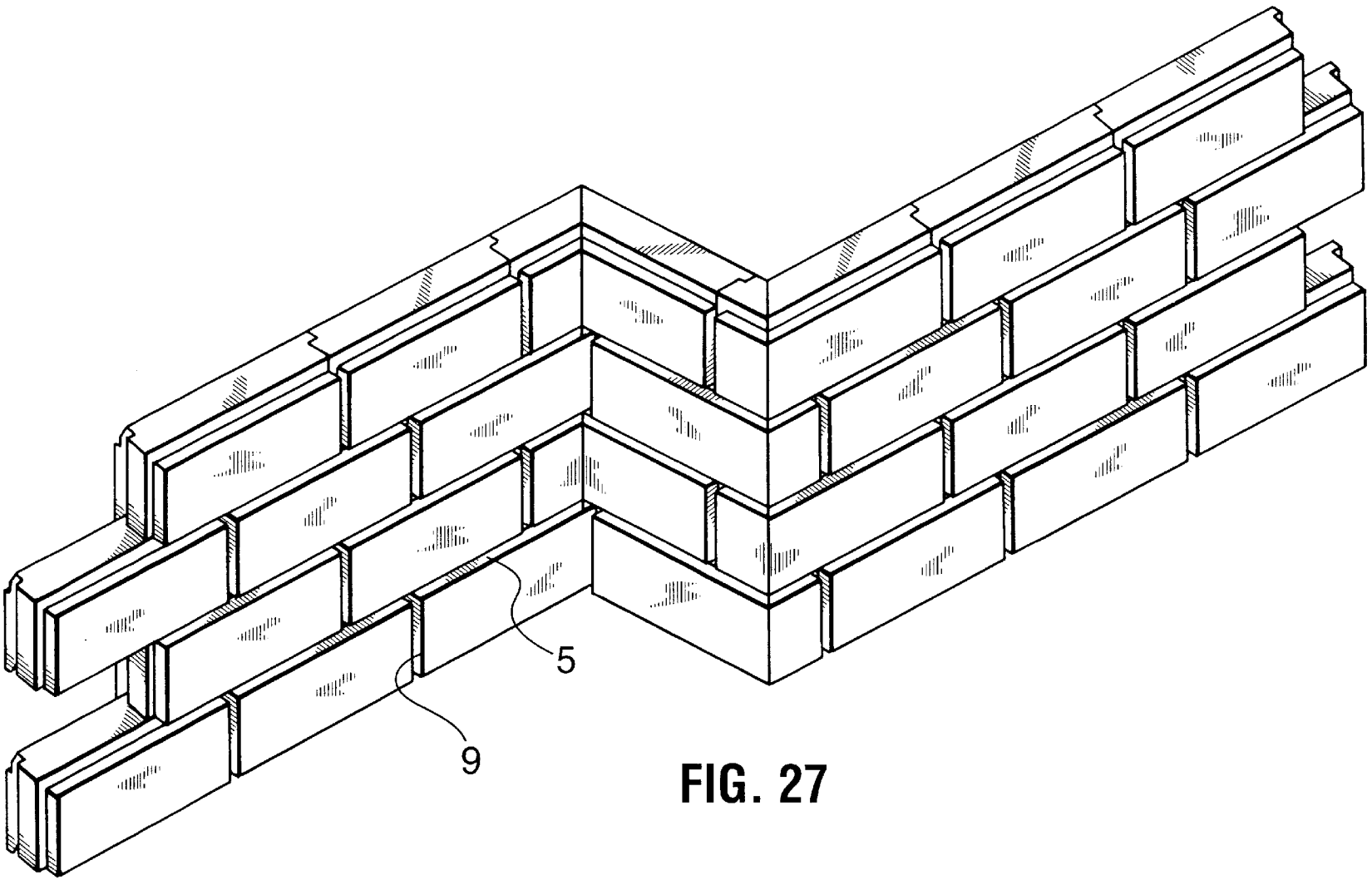
FIG. 27 is a front perspective view of a wall constructed with the bricks of the present invention.
Figure 29:
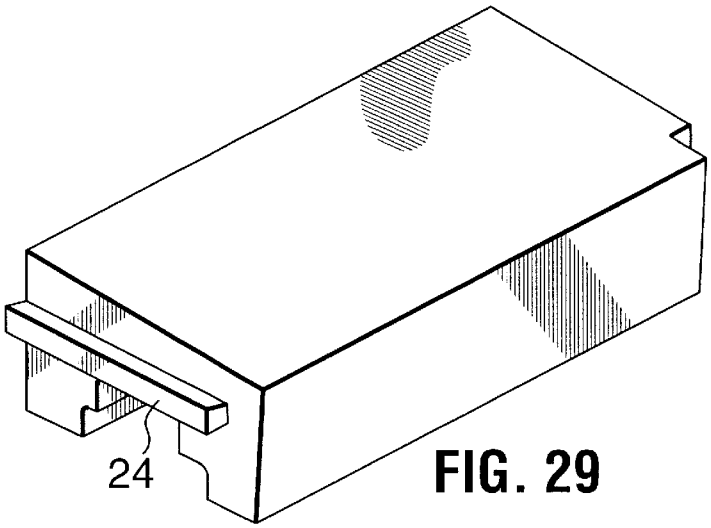
FIG. 29 is a top left front corner perspective view of the sill of FIG. 28.
Figure 28:
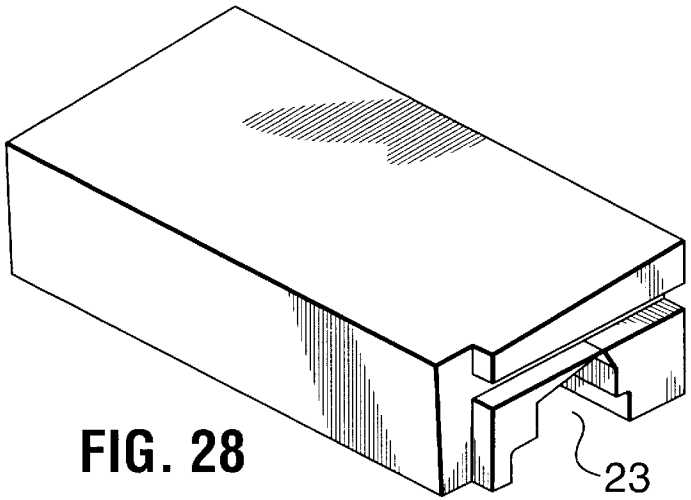
FIG. 28 is a top right front corner perspective view of a sill module for use with the bricks of the present invention.
Figure 31:
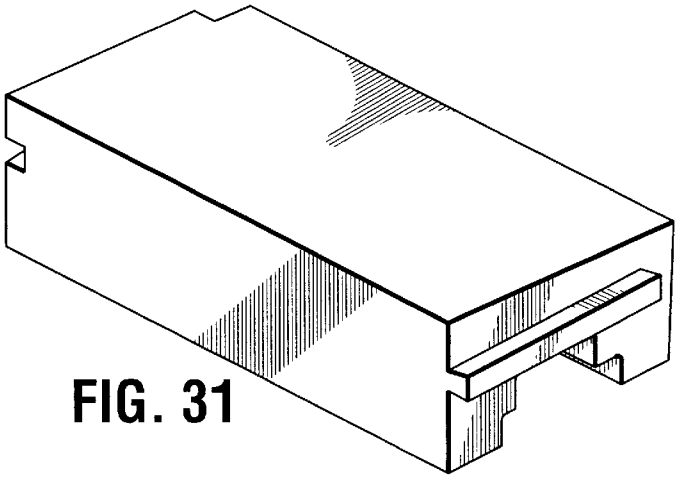
FIG. 31 is a top left rear perspective view of the sill of FIG. 28.
Figure 30:
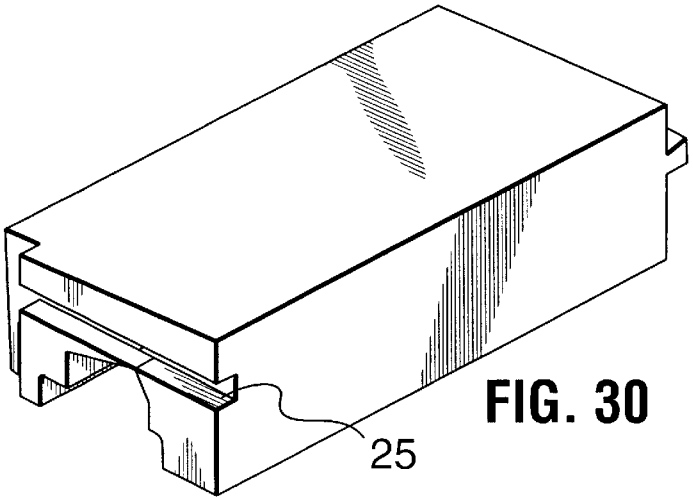
FIG. 30 is a top right rear perspective view of the sill of FIG. 28.
Figure 32:
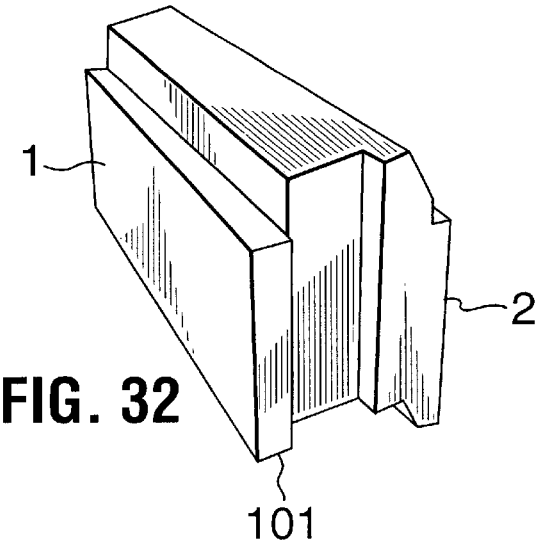
FIG. 32 is a top front corner perspective of an alternative embodiment of the brick of the present invention.
Figure 33:
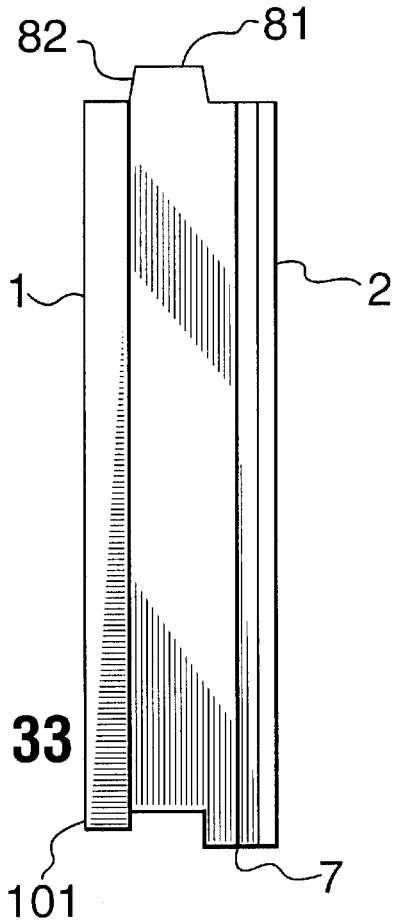
FIG. 33 is a top view of the brick shown in FIG. 32.
Figure 34:
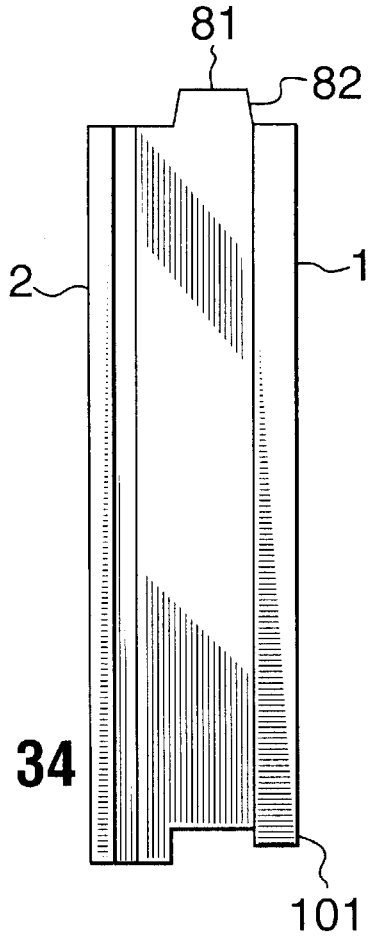
FIG. 34 is an underside view of the brick shown in FIG. 32.

Referring now to the drawings, in FIG. 1–8, the basic course to course interlocking structure of the mortarless brick of the present invention is shown. As can be seen, the brick of the present invention has flat vertical front 1 and rear 2 faces. The top surface of each brick is defined by a ridge 3 that interfits with a groove 4 on the lower surface of the brick. Ridge 3 is of greater height than groove 4, to provide the visual appearance of a mortar line 5 between courses of bricks, as can best be seen in FIGS. 3, 4 and 27.

Ridge 3 is preferably provided with a forwardly sloped portion 6 and a rearwardly sloped portion 26. The sloped portions 6, 26 of ridge 3 permit water that may enter between the courses to drain from between stacked bricks.

A lap joint that is formed between adjacent bricks in a row by the overlap of front 8 and rear 7 end flanges of adjacent bricks. Moreover, as can be seen from FIGS. 5, 6 and 27, front end flange 8 of a brick is recessed from the front face 1 of a brick to present the appearance of a mortar line 9 between adjacent bricks in a row.

In a particularly preferred form of the present invention, shown in FIGS. 32–34 and 37, front flange 81 is tapered inwardly slightly, to permit a solid fit between bricks formed of concrete. The taper at the forward edge 82 also creates a water channel for carrying away water that may be blown by wind between the bricks. In the FIGS. 32–34 and 37 embodiment, a further flange 101 is formed in the front face 1 of the brick, opposite rear flange 7, to hide the joint line between front flange 8/81, and the end of a brick adjacent rear flange 7. Therefore, the appearance of a mortar line will be heightened.

Figure 1:
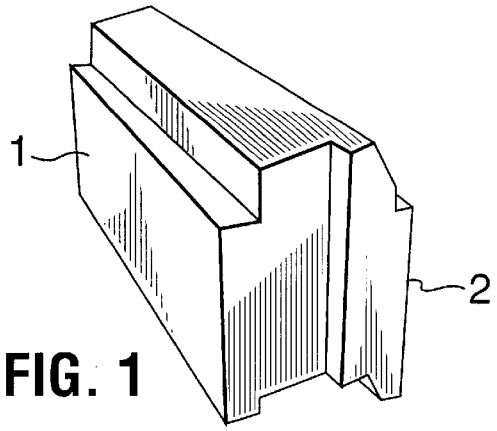
FIG. 1 is a top front corner perspective of a dry stack brick according to the present invention.
Figure 2:
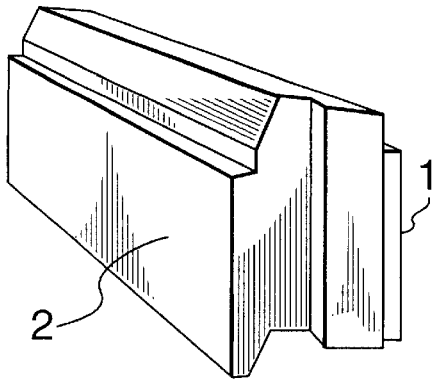
FIG. 2 is a top rear corner perspective of a dry stack brick according to the present invention.
Figure 3:
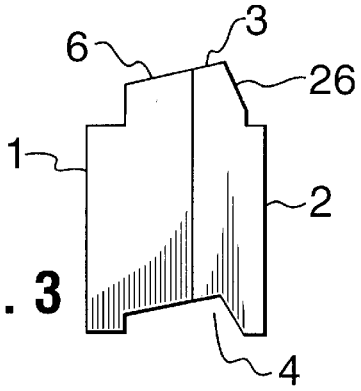
FIG. 3 is an end view of one end of the brick of FIG. 1.
Figure 4:
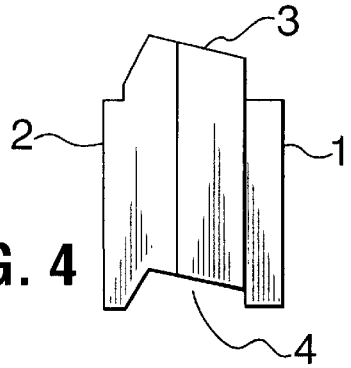
FIG. 4 is an end view of the other end of the brick of FIG. 1.
Figure 5:
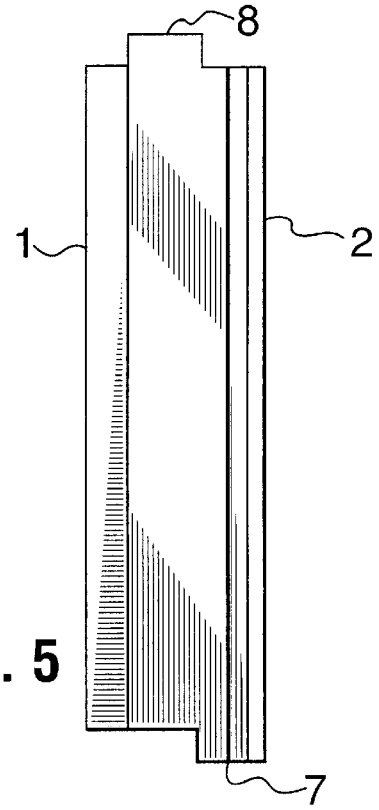
FIG. 5 is a top view of the brick of FIG. 1.
Figure 6:
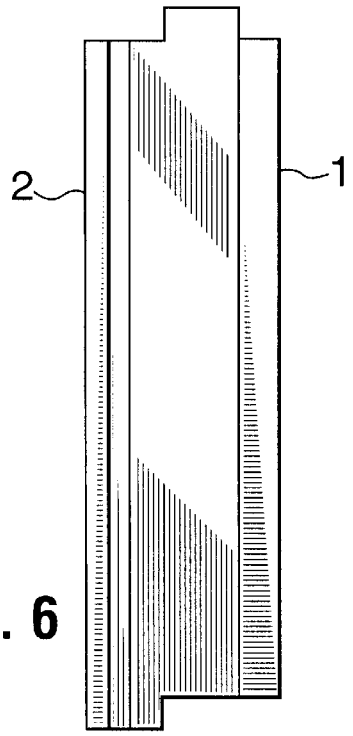
FIG. 6 is an underside view of the brick of FIG. 1.
Figure 7:
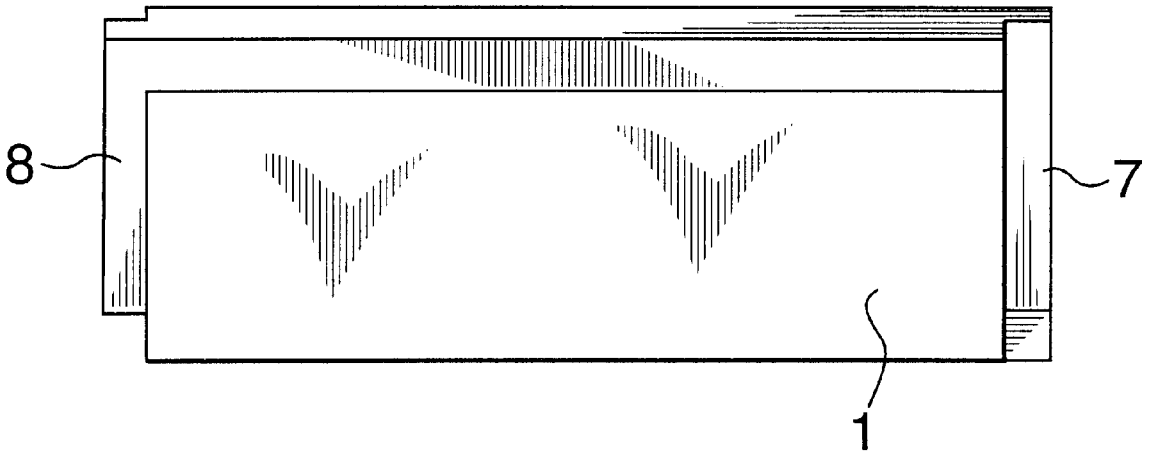
FIG. 7 is a front view of the brick of FIG. 1.
Figure 8:
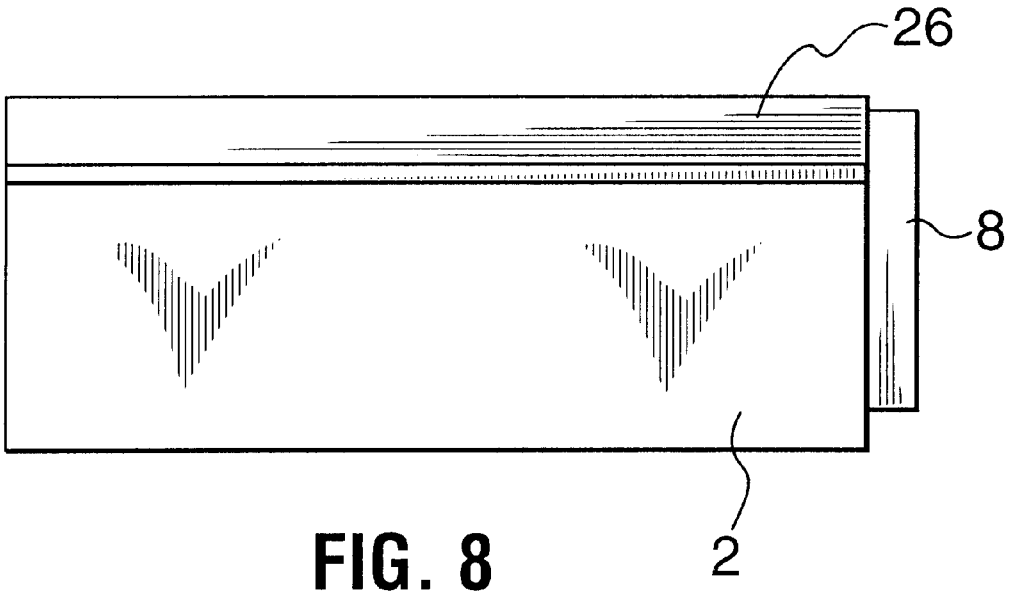
FIG. 8 is a rear view of the brick of FIG. 1.
Figure 9:
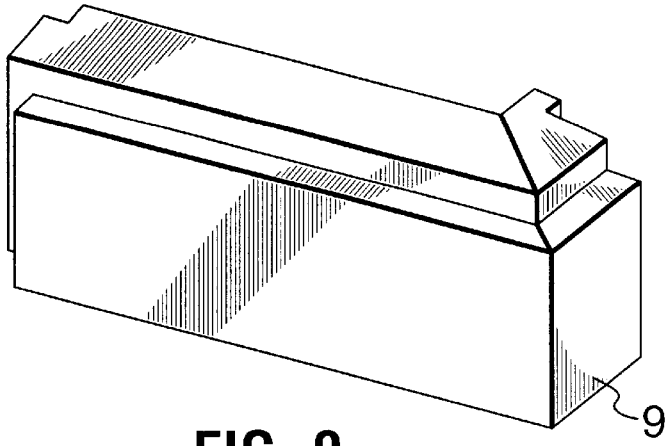
FIG. 9 is a front perspective of a left outside corner brick according to the present invention.
Figure 10:
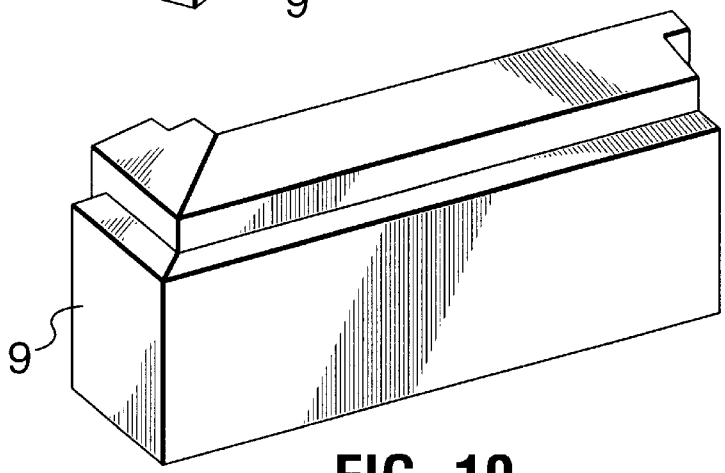
FIG. 10 is a front perspective of a right outside corner brick according to the present invention.
Figure 11:
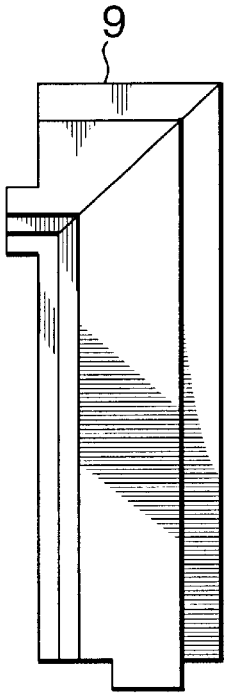
FIG. 11 is a top view of the brick of FIG. 9.
Figure 12:
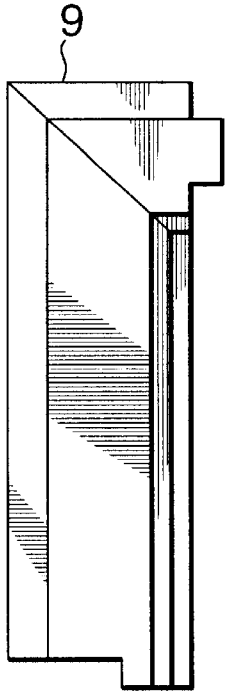
FIG. 12 is a top view of the brick of FIG. 10.
Figure 13:
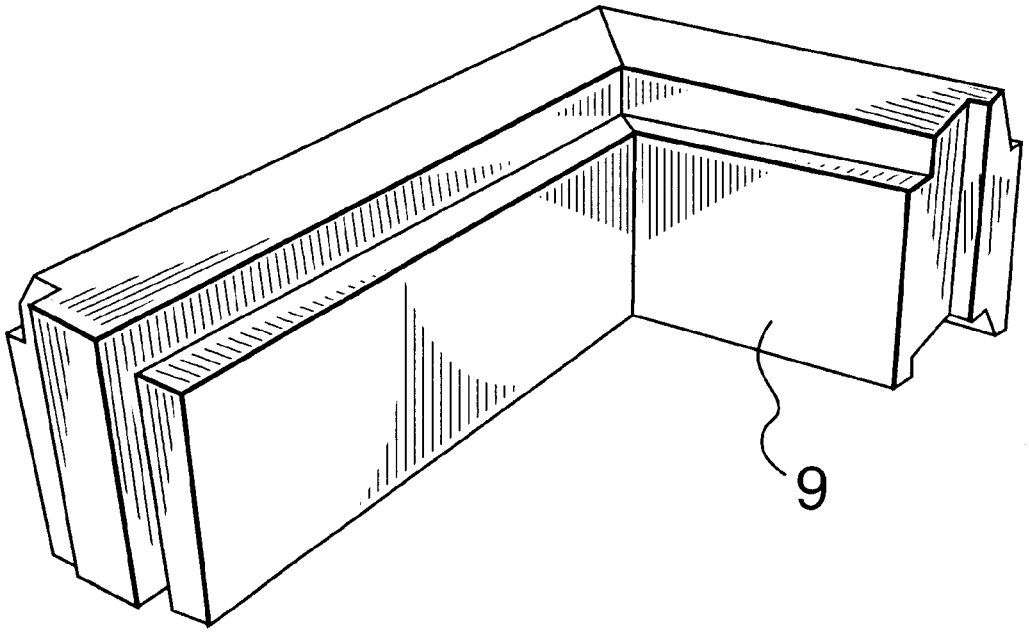
FIG. 13 is a front perspective of a right inside corner brick according to the present invention.
Figure 14:
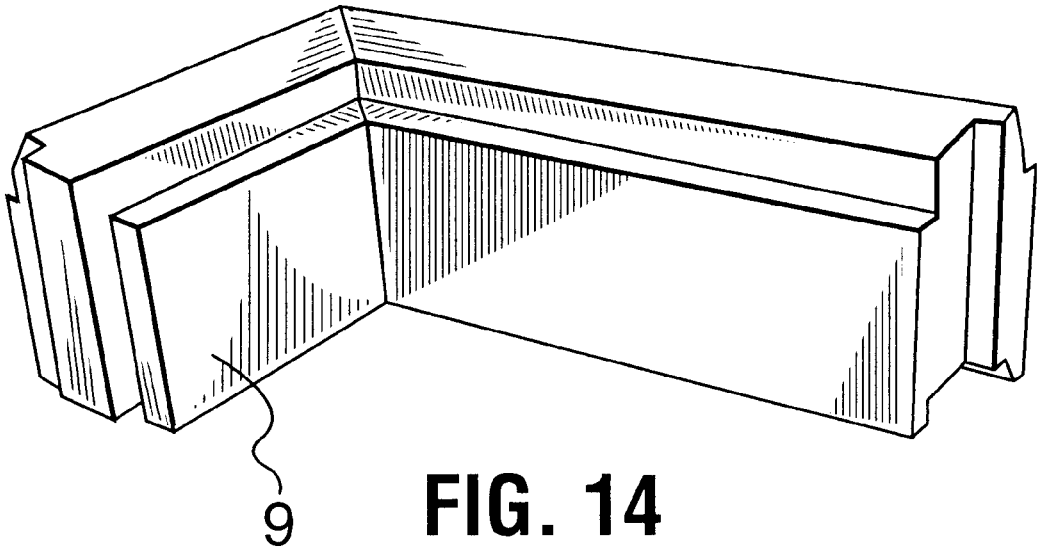
FIG. 14 is a front perspective of a left inside corner brick according to the present invention.
Figure 15:
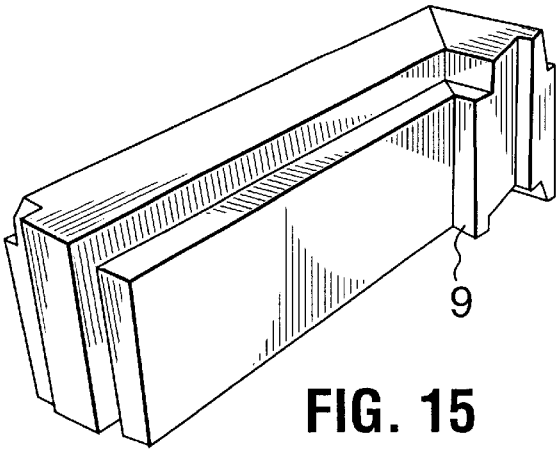
FIG. 15 is a front perspective alternate embodiment of an inside right corner brick according to the present invention.
Figure 16:
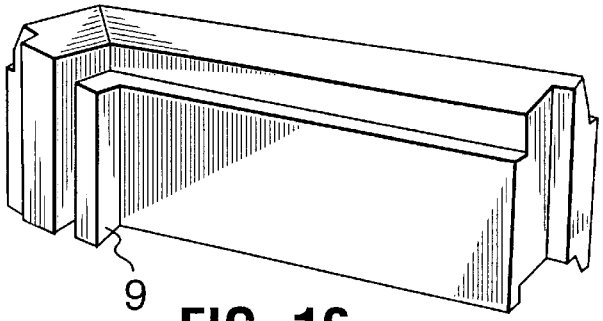
FIG. 16 is a front perspective of an alternate embodiment of an inside left corner brick according to the present invention.

Corner bricks according to the present invention are illustrated in FIGS. 9–17. The outside corners of FIGS. 9 and 10, and the inside corners of FIGS. 13 and 14 are basically the same brick as illustrated in FIGS. 1–8, but angulated at a point near the end of each brick, at 90°, to present an end surface 9 that is the same length as the width of a brick. Alternatively, as shown in FIGS. 15 and 16, by way of example, the end wall 9 may be quite abbreviated, or it may be made any other length desired, depending on the look of the bond desired.

Figure 35:
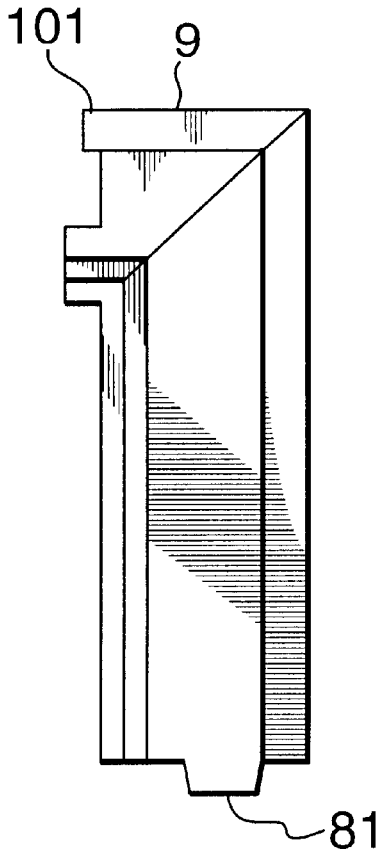
FIG. 35 is a top view of an outside corner brick according to the alternate embodiment of the present invention.
Figure 36:
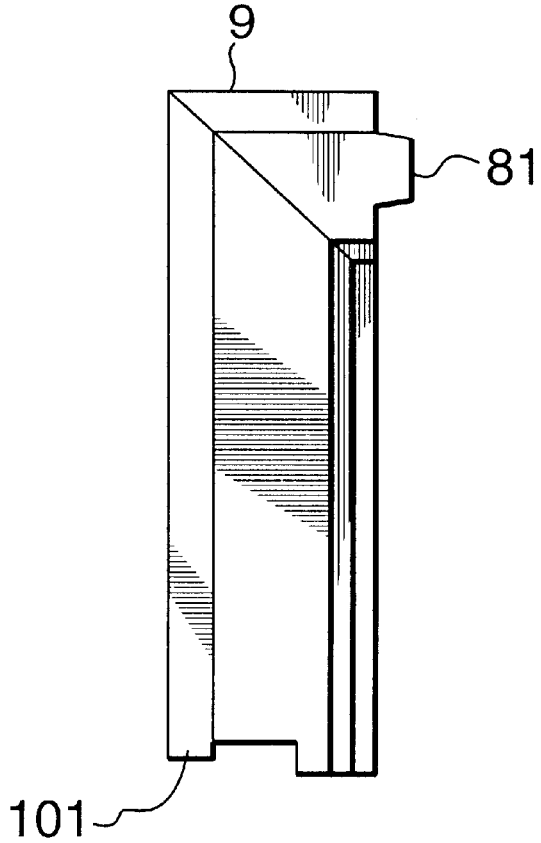
FIG. 36 is an underside view of the corner brick shown in FIG. 35.
Figure 37:
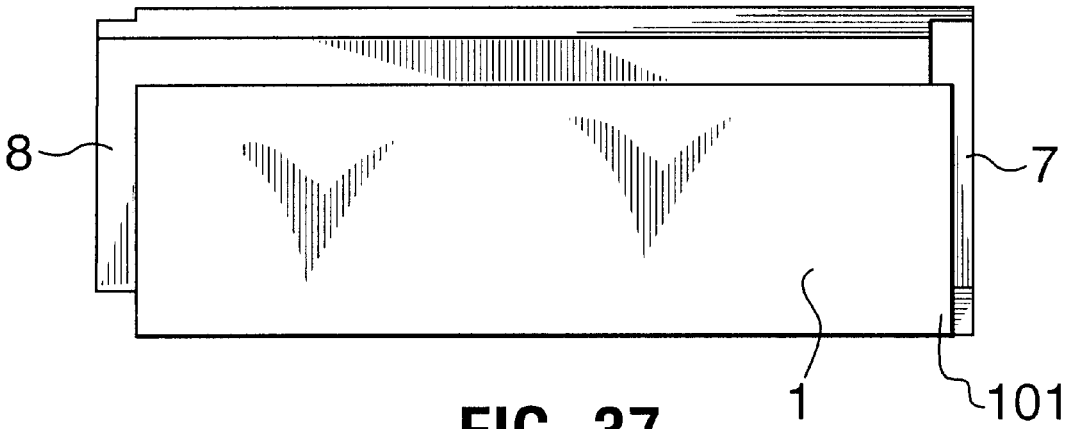
FIG. 37 is a front view of the brick shown in FIG. 32.
Figure 38:
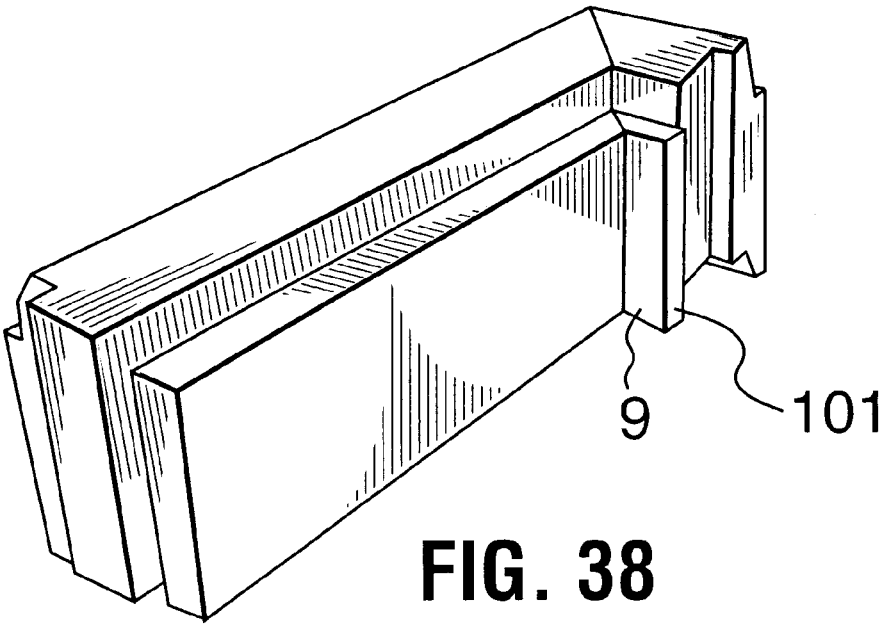
FIGS. 38 and 39 are perspective views of inside corner bricks according to the alternate embodiment of the present invention shown in FIG. 32.
Figure 39:
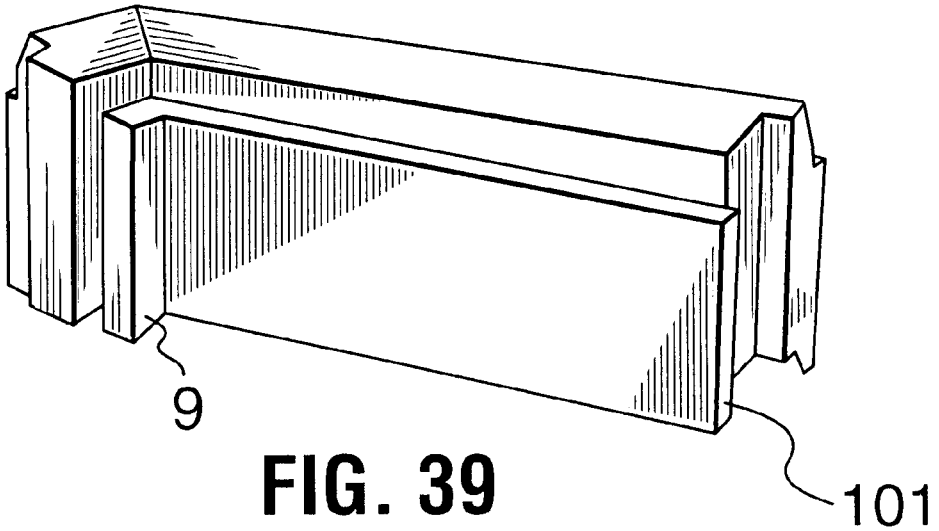

Outside and inside corner bricks utilizing the preferred embodiment of the present invention in which a tapered front flange 81, and an additional overlapping flange 101 on the opposite end, front face of the brick are shown in FIGS. 35, 36 (outside) and 38, 39 (inside). Other angles, such as 30° or 45° are also possible.

Figure 17:
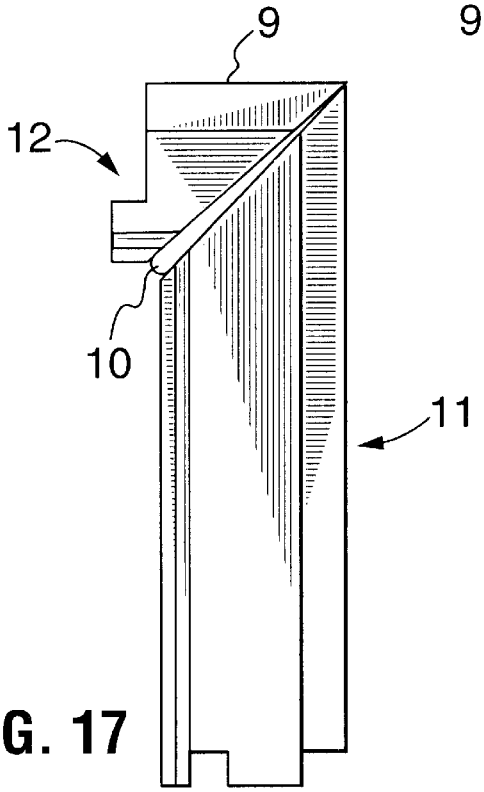
FIG. 17 is a top view of a two part corner (outside left is illustrated by way of example only) according to an alternate embodiment of the present invention.

Moreover, the corner may be constructed in two pieces, as shown in FIG. 17, in which case a bead of caulking 10 is placed between the two pieces 11 and 12. As shown in FIG. 17, the two pieces, assembled, make basically the same block as if molded in one piece.

Figure 18:
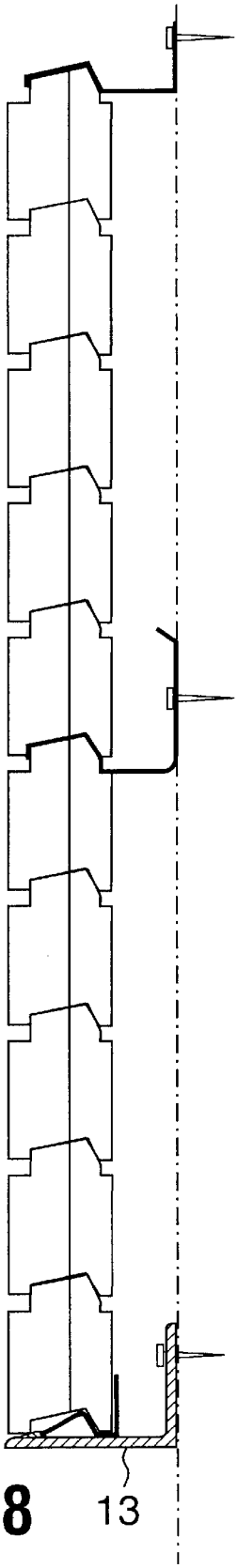
FIG. 18 is a sectional view of a wall constructed with bricks according to the present invention.
Figure 22:
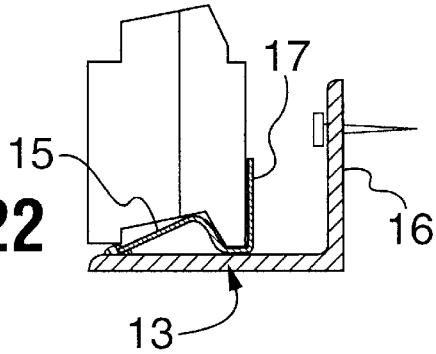
Figure 23:
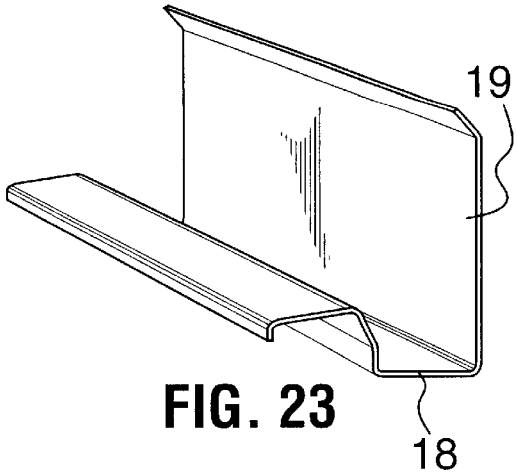
FIG. 23 is a perspective view of the wall tie shown in FIGS. 19 and 20.
Figure 24:
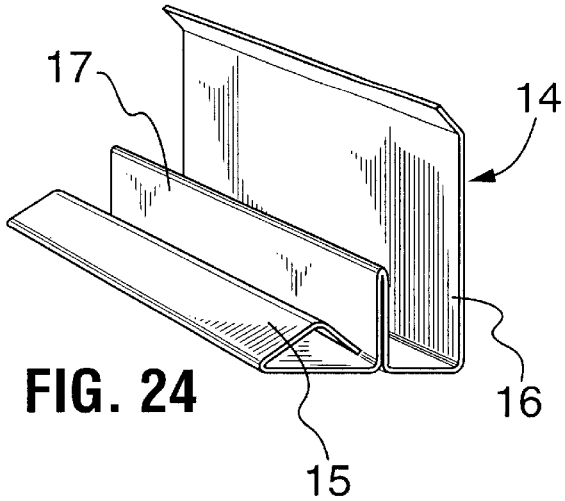
FIG. 24 is a perspective view of the base wall tie shown in FIG. 21.
Figure 25:
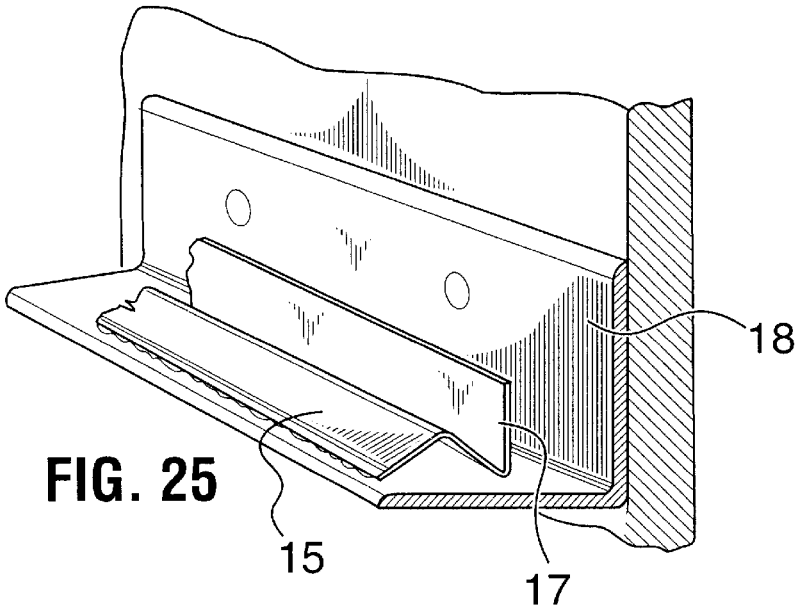
FIG. 25 is a perspective view of the base wall tie shown in FIG. 22.

FIGS. 18–26 illustrate tie angles for maintaining the structure of a wall constructed according to the present invention, in place against a wall. In FIGS. 18 (bottom), 21 and 22, starter or base ties 13, 14 are shown, that conform to the shape of the groove in the bottom surface of the brick of the present invention. The base tie 13,14 includes a profiled base 15 and a wall plate 16, to be screwed or otherwise fastened to a wall, such as a framed plywood wall. A spacer plate 17 extending upwardly from the base plate 10 maintains the brick a desired distance from the wall, to permit air circulation. The embodiment of FIG. 21, fabricated from thin, sheet metal such as steel or aluminum is for use when the lowest course of bricks is to rest on a foundation or other solid wall. The embodiment of FIG. 22 is made partly from an angle iron for securing to a wall, as shown in FIG. 18.

Figure 19:
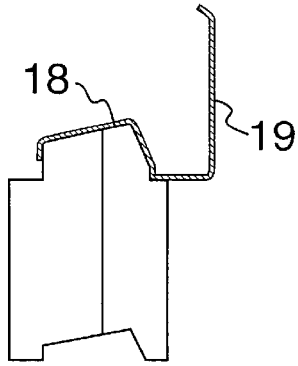
FIGS. 19 and 20 are end view of alternative placements of wall ties for securing courses of bricks to a wall.
Figure 20:
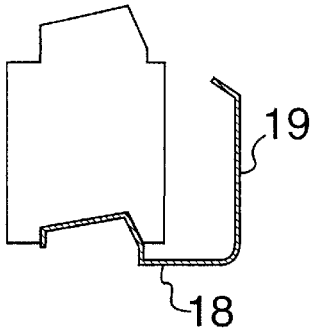
Figure 21:
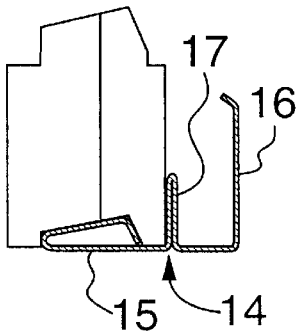
FIGS. 21 and 22 are end views of alternative embodiments of base wall ties for securing the base of a wall of bricks to a building.

In FIGS. 19 and 20, a wall tie is shown, for placement between courses of bricks, to maintain them straight and plumb. The wall tie consists of a profiled base 18 to be inserted between courses, a wall plate 19 for fastening to a wall. Wall ties are meant to be inserted between every first to fourth course of bricks, depending on the needs of a particular location.

Figure 26:
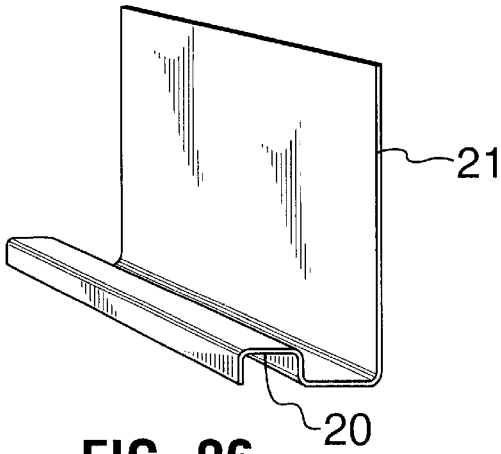
FIG. 26 is a perspective view of a vertical wall tie for securing an end of a brick of the present invention to a wall structure.

In FIG. 26, a wall tie angle for insertion between bricks in a course is shown. It consists of a profiled bracket portion 20 for gripping an end edge 7 of a brick and spacing it from a wall, and a wall plate 21, for attachment to a wall.

Figure 40:
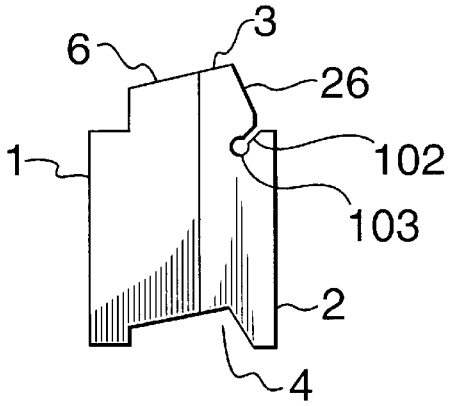
FIG. 40 is an end view of a brick according to any embodiment of the present invention, incorporating a channel for a brick tie.
Figure 41:
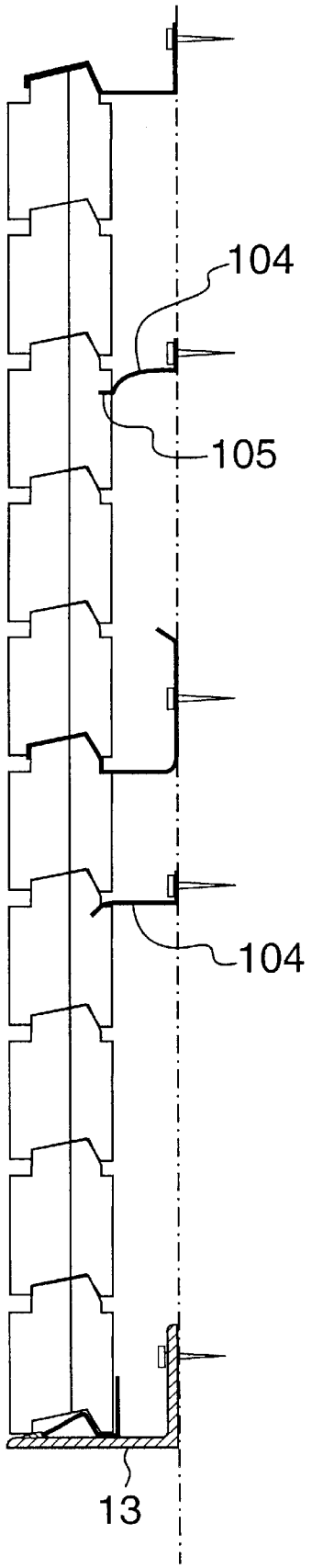
FIG. 41 is a side schematic view of a stack of bricks according to the present invention, showing three different brick ties for affixing the bricks of the present invention to a wall.
Figure 42:
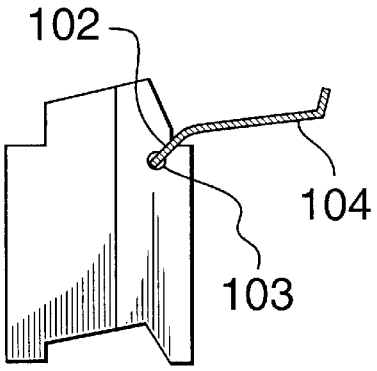
FIG. 42 is a detail view of a portion of FIG. 41.

FIGS. 40–42 illustrate a further preferred wall tie system for use with the brick of the present invention.

Referring to FIG. 40, a channel 102 with an enlarged cavity is formed in the rearward facing surface of the brick of the present invention, preferably at the upper edge of rear face 2, where it joins rear sloped portion 26 of ridge 3.

The channel 102 and cavity 103 are formed as a continuous profile in the rear face of the brick, for insertion, as shown in detail in FIGS. 41 and 42 of a conventional brick tie 104. In order to remain firmly seated in cavity 103, the end of the brick tie is rolled over, for instance by being rolled onto a cotter pin one turn. The rolled end is then inserted into the channel/cavity 102/103 profile at one end of the brick, and the other end is nailed or screwed to support framing, as shown in FIG. 41. A conventional brick tie is fabricated from sheet steel, and is formed as a rectangle, which is provided with a spaced series of nail holes along its length.

Alternatively, a selected number of bricks may be provided with an ordinary masonry anchor 105 affixed to their rear face, near the upper edge thereof, for attachment of a conventional brick tie 104. In either case, it is important that the attachment of the tie 104 to a brick be near the upper edge thereof, so that the free end of tie 102 can be nailed or screwed to a support surface without the brick interfering with such operation.

Referring lastly to FIGS. 28–31, a sill for use with the bricks of the present invention is illustrated. The sill is provided with a main body 22 that has a recess 23 in it of a shape corresponding to the shape of ridge 3 brick of the present invention. One end of the main body 22 has a tongue 24 projecting therefrom, and the other end of a corresponding groove 25 formed therein. A sill may be the same length, or longer than a brick of the present invention.

It will be appreciated that a significant advantage of the present invention over known mortarless brick products is the shallow depth (front to rear) required, which represents savings of up to 50% in materials, while still presenting a brick pattern having many of the attributes of a more expensive and labour intensive brick and mortar wall.

It is to be understood that the examples described above are not meant to limit the scope of the present invention. It is expected that numerous variants will be obvious to the person skilled in the field of masonry without any departure from the spirit of the invention. The appended claims, properly construed, form the only limitation upon the scope of the invention.

The embodiments of the invention in which an exclusive property or privilege is claimed are defined as follows:

1. A building block for stacking with other like building blocks to fabricate a wall, said building block having top, bottom, front, rear and first and second end surfaces, the front and rear surfaces being substantially planar, the top surface having a ridge and the bottom surface having a channel with a width dimensioned to interfit said channel with the ridge on the top surface of another of said building blocks, the channel having a depth and the ridge having a height, the depth of the channel being less than the height of the ridge for forming a gap between the front surfaces of vertically stacked blocks, the first end of the block comprising a first square notch extending from the top to the bottom of said block and being open to the front, the second end of said block comprising a second square notch extending from the top to the bottom of said block and being open to the rear, the forwardly open first square notch of one said block being dimensioned to overlap with the rearwardly open second square notch of another of the blocks, the second end of the block further having a forwardly open square notch to provide a vertical gap between blocks in a course of stacked blocks, wherein the front surface of said block, adjacent said first notch open to the front, extends laterally to form a short flange coplanar with said front surface, overhanging the edge of block.

2. A block as claimed in claim 1, wherein said short flange, in a course of stacked blocks, extends partly into said third forwardly open square notch, to obscure the vertical joint between an adjacent pair of blocks.

3. A block as claimed in claim 2, wherein said second notch, and said third notch are slightly bevelled, to define a tapped tongue between them.

4. A block as claimed in claim 1, including a profiled channel formed in the rear surface of the block, for accepting a brick tie with a complementary formed end.

5. A block as claimed in claim 4, wherein said channel is formed at the junction of said ridge and the rear surface of the block.

6. A block as claimed in claim 5, wherein said channel is inclined, and has a cavity of increased size formed in the end thereof.

7. A block as claimed in claim 1, wherein an anchor is provided in the rear surface thereof, for attachment of a brick tie.

8. A block as claimed in claim 7, wherein said anchor is located adjacent the upper edge of said rear surface.

9. A block as claimed in claim 1 when said brick is angulated at a point along its length to present a front surface in two portions at an angle to one another.

10. A block as claimed in claim 9, wherein said angle is 30°.

11. A block as claimed in claim 9, wherein said angle is 45°.

12. A block as claimed in claim 9, wherein said angle is 90°.

* * * * *